US005655964A

United States Patent [19]

Rheault et al.

[11] Patent Number: 5,655,964

[45] Date of Patent: Aug. 12, 1997

[54] STATIC ROOF VENTILATOR

[76] Inventors: Andre Rheault, 120 Clairevue Blvd. W., St-Bruno-de-Montarville, District of Longueuil, Canada, J3V 1R1; Guy Proulx, 720 Brodeur St., Apt. 4, Longueuil, District of Longueuil, Canada, J4J 2S8; Raymond Maisonneuve, 2110 St-Georges St., Longueuil, District of Longueuil, Canada, J4K 4A6

[21] Appl. No.: 450,643

[22] Filed: May 25, 1995

(Under 37 CFR 1.47)

[30] Foreign Application Priority Data

Apr. 19, 1995 [CA] Canada ..... 2147297

[51] Int. Cl.[6] ..... F24F 7/02

[52] U.S. Cl. ..... 454/368

[58] Field of Search ..... 454/368, 367, 454/33, 36, 38; D23/260, 373, 374, 393

[56] References Cited

U.S. PATENT DOCUMENTS

| | | | |
|---|---|---|---|
| 2,737,876 | 3/1956 | Smith | 454/368 |
| 2,868,106 | 1/1959 | Knutson . | |
| 2,885,944 | 3/1959 | Bates | D23/393 X |
| 3,049,068 | 8/1962 | Rousey | D23/373 X |
| 3,338,006 | 8/1967 | Belden | 454/368 |
| 5,421,776 | 6/1995 | Sakamoto et al. | 454/368 |

FOREIGN PATENT DOCUMENTS 1 181 281 1/1985 Canada .

*Primary Examiner*—Harold Joyce
*Attorney, Agent, or Firm*—Christopher W. Brody

[57] ABSTRACT

This static ventilator is made with three parts: 1) a hollow housing, triangular shaped with circumferential sidewalls and louvers attached to the outside walls, 2) a triangular shaped base fixed to the roof and 3) a cap at the top. The hollow housing is the part that actually does the ventilation. Each of its louvers is inclined downwards and out and comes with a piece of filter material preventing anything from entering the vent openings and allowing the air to circulate. The triangular shape of the hollow housing allows the wind to slide laterally along each side of the ventilator and prevents any snow or debris accumulation at the base and on the louvers of the ventilator. In order to secure the hollow housing to the roof surface, a triangular shaped piece serves as a base where the hollow housing is inserted. This base also lets the condensed water flow out of the hollow housing. The cap seals the hollow housing and prevents anything from falling straight into the ventilator.

6 Claims, 2 Drawing Sheets

STATIC ROOF VENTILATOR

The present invention relates to a static roof ventilator. The purpose for building this new product comes with a dissatisfaction of the actual products on the market. The facts are hereby explained.

FACTS ABOUT VENTILATORS

Roof ventilators are used to take the air out of the attic and replace it by colder air from outside. Generally, a roof ventilator is either mechanical or static. The mechanical type requires maintenance et makes noise as the static ones, because of their chimney effect, do not require any maintenance. The two types of ventilator have clogging problems at the exits when a storm comes due to the snow and/or ice accumulation. Also, snow and/or debris can build up at the base; often rectangular. Condensation problems can also occur along the inner walls damaging the interior of the house.

SUMMARY OF THE INVENTION

The problems encountered on the market as we have just stated could be resolved by a static triangular shaped ventilator with louvers. Contrary to a rectangular shaped ventilator, it is the triangular shape of the hollow housing (with its three sidewalls on which each has one or more downward and outward louvers) that allows the wind to slide laterally along each side of the ventilator which improves the chimney effect and prevents any accumulation of snow, ice or debris around the base or on the louvers.

Moreover, the triangular base fixed to the roof made to receive the hollow housing vertically allows the condensed water to escape; therefore, condensation problems are eliminated.

Each louver also have a useful purpose. With a piece of filter material, they prevent anything from entering the vent

DESCRIPTION OF THE VENTILATOR'S DRAWINGS

Drawings

DETAILED DESCRIPTION OF VENTILATOR'S ELEMENTS

Figure 3:
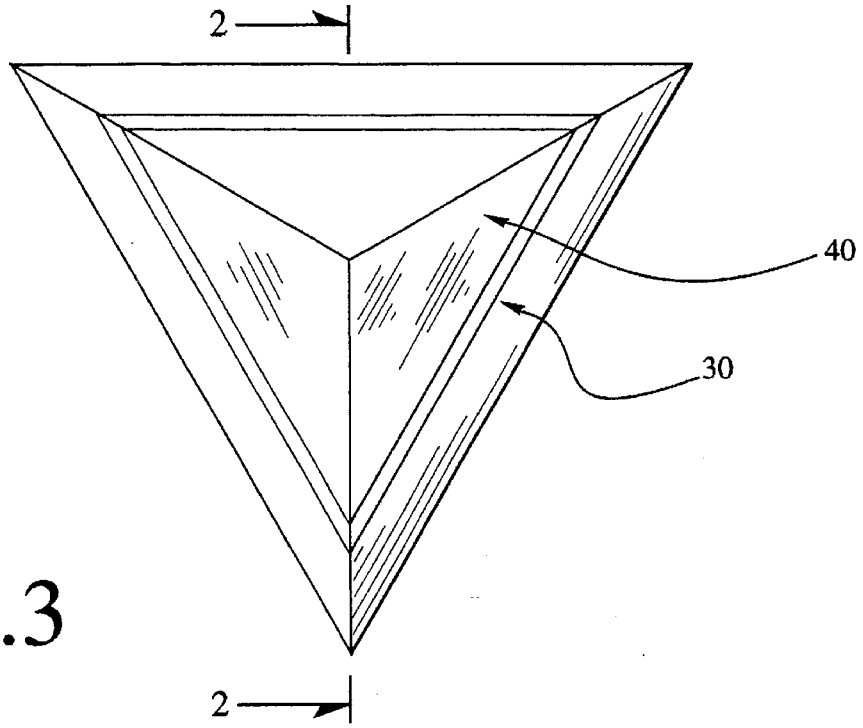
FIG. 3 is a top view
Figure 1:
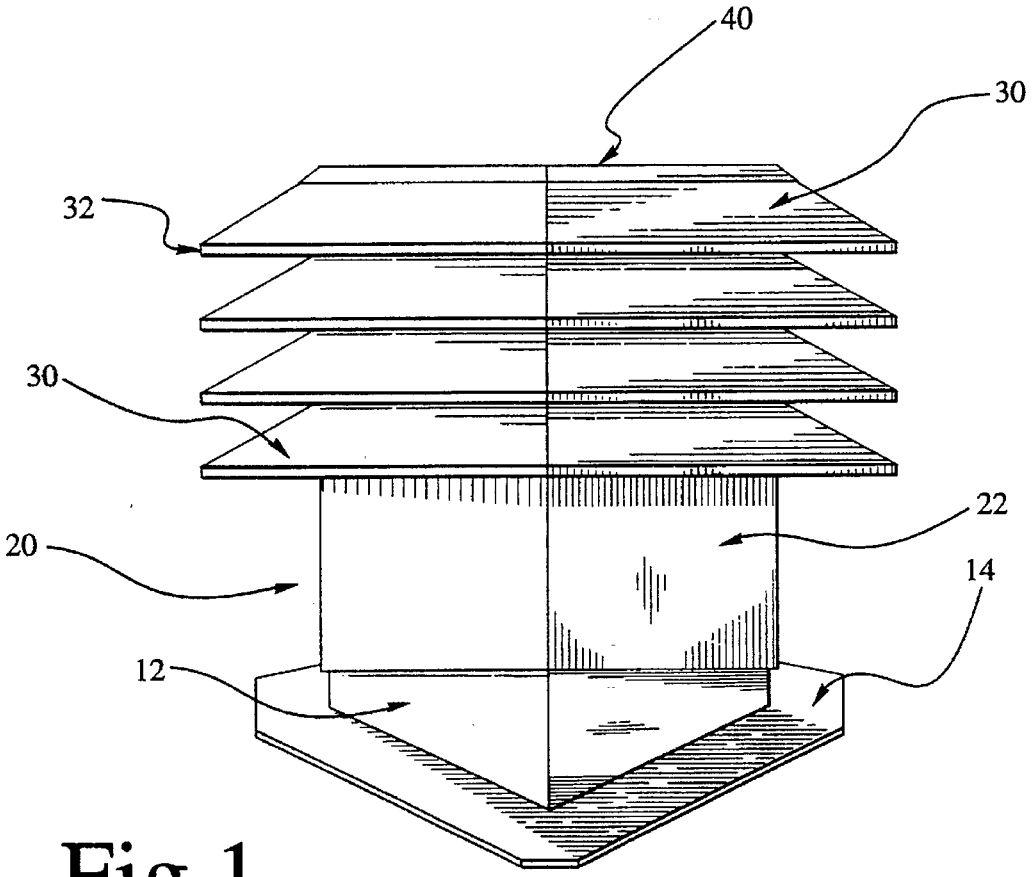
FIG. 1 is the front elevation view
Figure 2:
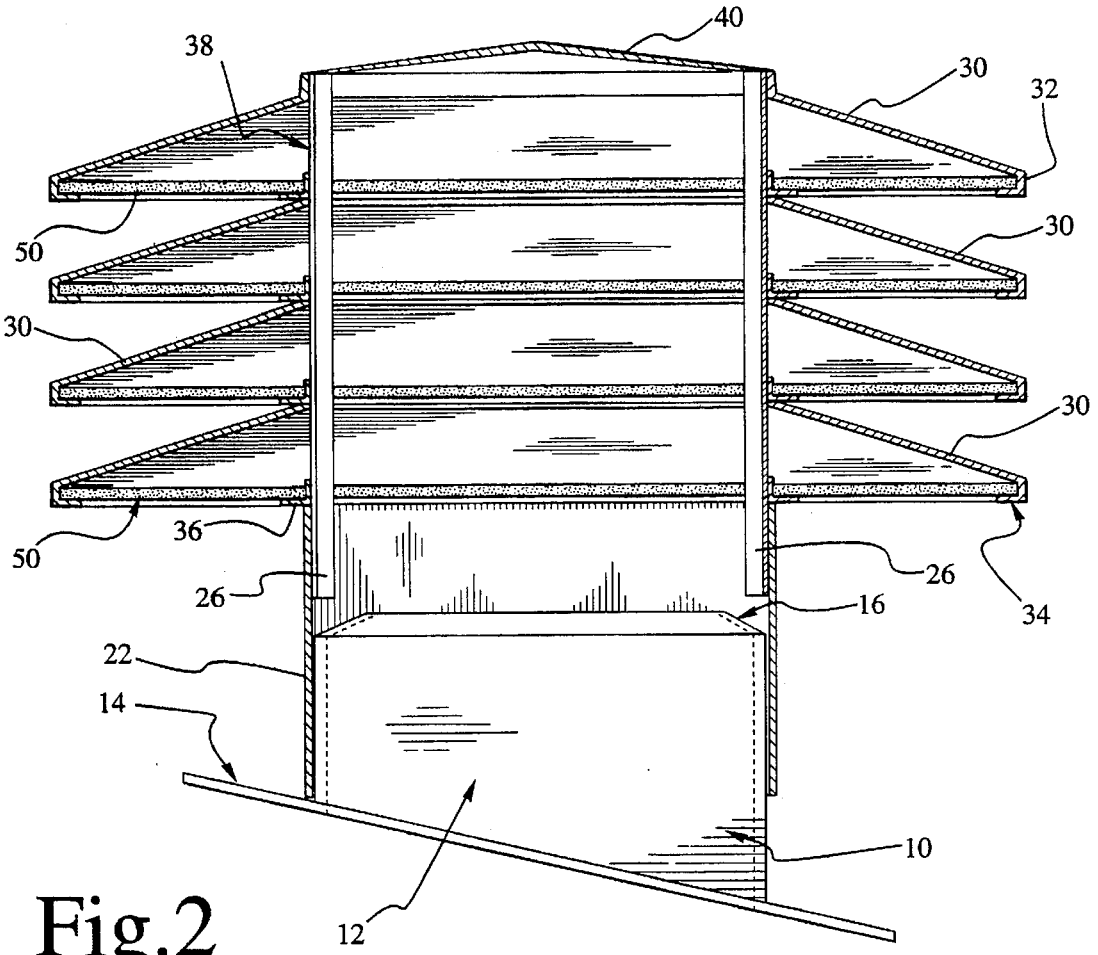
FIG. 2 is a cross sectional view of FIG. 1 showing the inside of the ventilator

FIG. 2 drawing shows the roof ventilator made up of a triangular shaped hollow base 10 which has three sidewalls 12 with their upper edge 16 inclined. The roof ventilator is nailed to the roof surface through the flange plate 14. The bottom and top sections are opened.

The housing 20 is made of three sidewalls 22 each provided with at least one louver 30. FIG. 2 shows four louvers. Each one 30 is spot welded on a L-shaped support 26 in turn spot welded to the inner face of each housing's sidewalls 22.

Each louver's 30 interior and exterior flange 34 is folded horizontally in order to support the detachable filter material 50. This filter material 50 is made of fiberglass, is washable, nonabsorbant and resistant. It lets the air flow through easily and is very efficient against snow, bugs and/or dust. A L-shaped support 36 welded to the outer surface of the housing sidewall 22 holds the other end of the filter material 50.

A top cover 40 is screwed to the upper part of the hollow housing 20 and seals it.

Figure 4:
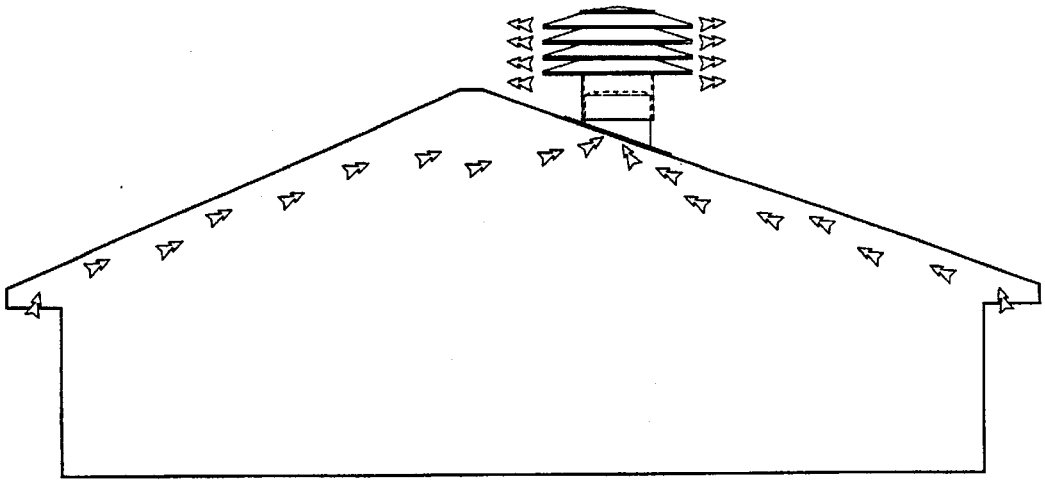
FIG. 4 is a view of a ventilator once installed on an inclined roof

FIG. 4 shows the chimney effect of the roof ventilator replacing the air coming from the attic with colder air from outside flowing through the cornices.

What is claimed is:

1. A static roof ventilator including:

a triangular-shaped hollow housing comprising a base and three sidewalls, each sidewall supporting one or more louvers inclined downward and outward, the louvers being secured to the sidewalls by a plurality of inner L-shaped supports and a triangular-shaped base which receives a bottom open end of the hollow housing for fixing the hollow housing to a roof.

2. A static roof ventilator as claimed in claim 1 wherein the triangular-shaped base fastening the hollow housing to a roof includes:

a triangular-shaped hollow base opened at a top and at a bottom thereof and having three base sidewalls, the triangular-shaped hollow base sliding into the hollow housing and making the triangular-shaped hollow base stand securely in an upright manner vertically and a flange plate to fasten the hollow base to an inclined roof.

3. A static roof ventilator as claimed in claim 2 wherein the triangular-shaped hollow base set into the hollow housing has three base sidewall edges, each edge inclined inward and upward to let condensed water formed on the sidewalls of the hollow housing to run down outer surfaces of the sidewalls of the triangular-shaped hollow base and away from the static roof ventilator.

4. A static roof ventilator as claimed in claim 3 comprising a triangular-shaped removable top cover fastened by screws to an upper part of the hollow housing.

5. A static roof ventilator as claimed in claim 4 comprising a filter material made of glass fiber placed in each louver, the filter material held on one side by a folded edge of each louver and on the other side by an outer L-shaped support welded to at least one of the plurality of the inner L-shaped support.

6. A static roof ventilator as claimed in claim 5, wherein each louver is welded to the outer L-shaped support and an upper slat of each louver is inclined downward and outward, each louver including a flange at an underneath edge thereof as said folded edge in order to hold the filter material.

* * * * *